US005315913A

United States Patent [19]

Rossier et al.

[11] Patent Number: 5,315,913

[45] Date of Patent: May 31, 1994

[54] GUN MECHANISM FOR RAPIDLY FIRING CASED TELESCOPED AMMUNITION

[75] Inventors: Glenn E. Rossier, Ferrisburgh; Steven R. Duke, Williston; Edward A. Proulx, Burlington; Stephen A. Jarvis, Colchester, all of Vt.

[73] Assignee: General Electric Company, Philadelphia, Pa.

[21] Appl. No.: 993,559

[22] Filed: Dec. 21, 1992

[51] Int. Cl.[5] ..... F41F 1/10

[52] U.S. Cl. ..... 89/12; 89/13.05

[58] Field of Search ..... 89/12, 11, 13.05

[56] References Cited

U.S. PATENT DOCUMENTS

| | | | |
|---|---|---|---|
| 125,563 | 4/1872 | Gatling | 89/12 |
| 2,849,921 | 9/1958 | Otto | 89/12 |
| 3,380,343 | 4/1968 | Chiabrandy | 89/12 |
| 3,611,871 | 10/1971 | Kirpatrick | 89/127 |
| 3,698,283 | 10/1972 | Ashley et al. | 89/12 |
| 3,760,683 | 9/1973 | Seemann | 89/12 |
| 4,314,501 | 2/1982 | Kirkpatrick | 89/12 |
| 5,140,892 | 8/1992 | Koine | 89/13.05 |
| 5,147,978 | 9/1992 | Northrup | 102/434 |

OTHER PUBLICATIONS

Proposal for: "25MM Cased Telescoped Weapon System for VADS"—General Electric Co.—Apr. 24, 1973.

*Primary Examiner*—David H. Brown

*Attorney, Agent, or Firm*—Geoffrey H. Krauss

[57] ABSTRACT

A Gatling-type gun mechanism has a stationary housing having a camming channel and at least one loading/unloading port. A rotor is mounted inside the housing and can be rotated about a longitudinal axis; the rotor carries a plurality of gun barrels, each fixed to the rotor with a respective barrel axis substantially parallel to the rotor longitudinal axis; a like number of stud assemblies, each having a respective axis aligned with the axis of an associated gun barrel; and a like number of cartridge chambers, each interacting with the housing camming channel, during each rotation of said rotor, for reciprocal motion between a rearward location substantially coaxial about the associated stud assembly and a forward location substantially in abutment with the associated gun barrel and enclosing a volume into which a round of ammunition can be placed and removed by radial movement through the loading/unloading port. Each of the stud assemblies has a mechanism for firing a round of ammunition within the enclosed volume of the associated chamber, when that chamber is at its forward location, and when the rotor moves the associated barrel, chamber and stud assembly to a firing location.

16 Claims, 3 Drawing Sheets

GUN MECHANISM FOR RAPIDLY FIRING CASED TELESCOPED AMMUNITION

BACKGROUND OF THE INVENTION

The present invention relates to Gatling type guns and, more particularly, to a high-rate-of-fire gun mechanism having a plurality of barrels firing cased telescoped ammunition.

It is now known to provide high-rate-of-fire gun mechanisms of the Gatling type, such as described and claimed in U.S. Pat. No. 4,314,501, issued Feb. 9, 1982, to the assignee of the present application, and incorporated herein in its entirety by reference. It is highly desirable to utilize such mechanisms for firing cased telescoped ammunition, such as described, for example, in U.S. Pat. No. 5,147,978 which is, along with the references cited therein, incorporated herein by reference in their entirety. Prior Gatling-type guns are known which fired cased telescoped ammunition and used axial chamber motion, but required relatively complex structures for chamber movement and chamber locking functions. It is also highly desirable to provide a high firing rate mechanism having a minimum of moving parts, for ease of design, production, assembly and maintenance.

SUMMARY OF THE INVENTION

In accordance with the present invention, a novel gun mechanism having a high rate of fire of cased telescoped ammunition, comprises a stationary housing having a camming channel and at least one loading and/or unloading port, with a rotor which is mounted inside the housing for rotation about a longitudinal axis. The rotor carries: a plurality of gun barrels, each fixed to the rotor with a respective barrel axis substantially parallel to the rotor longitudinal axis; a like number of stud assemblies, each having a respective axis aligned with the axis of an associated gun barrel; and a like number of cartridge chambers, each having its axis aligned with the axis of the associated barrel and stud, and interacting with the housing camming channel, during each rotation of said rotor, for reciprocal motion between a rearward location substantially coaxial about the associated stud assembly and a forward location substantially in abutment with the associated gun barrel and enclosing a volume into which a round of ammunition can be placed and removed by radial movement through the loading/unloading port. Each of the stud assemblies has a mechanism for firing a round of ammunition within the enclosed volume of the associated chamber, when that chamber is at its forward location, and when the rotor moves the associated barrel, chamber and stud assembly to a firing location.

Accordingly, it is an object of the present invention to provide a novel rotary gun mechanism for firing cased telescoped ammunition.

This and other objects of the present invention will become apparent upon reading the following detailed description of a presently preferred embodiment, when considered in conjunction with the associated drawings.

DETAILED DESCRIPTION OF A PRESENTLY PREFERRED EMBODIMENT

Figures 1, 1A, 1B:
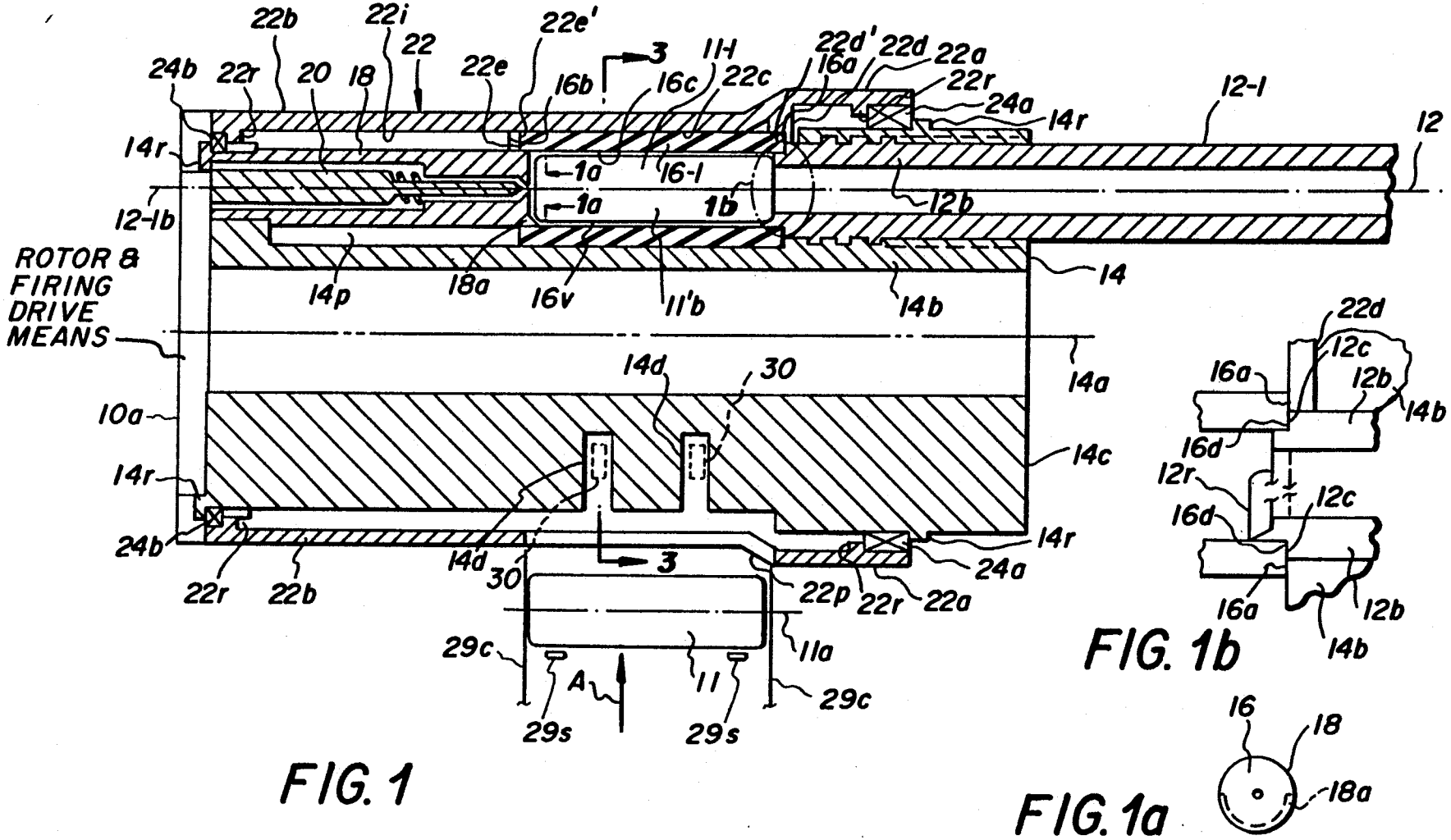
FIG. 1 is a sectional view through a novel rotary gun mechanism in accordance with the present invention.
FIG. 1*a* is a sectional view through a firing chamber, looking aft toward the associated stud and its round-positioning lip.
FIG. 1*b* is an expanded view of the area at a barrel breech, illustrating firing chamber overlap and breech lip position.

Referring to all of the figures, a multiple-barrel, high-rate-of-fire gun mechanism 10 for firing a sequential series of cylindrical rounds 11 of cased telescoped ammunition in sequential ones of a plurality (e.g. three) of barrels 12 is shown. The barrels 12 (e.g. the first barrel 12-1, second barrel 12-2, and third barrel 12-3) are arranged with substantially equal angular distribution adjacent to the exterior periphery of a rotor member 14, which is rotated, by any of the known rotor drive means 10*a*; about an axis of rotation 14*a*. Thus, each of barrels 12-i, where $1 \leqq i \leqq n$ (where n is the number of barrels, herein illustrated as $n=3$), is arranged with its axis 12-ia along an associated one of barrel-position axes 12-ib, and with its breech end 12*b* captured within a suitable formation 14*b* formed in the front end 14*c* of the rotor. Associated with each barrel 12-i is an axially-reciprocating, cylindrical cartridge chamber 16-i, having a fore end 16*a* which can be slid axially forward to abut upon the breech end 12*b* of the associated barrel, and having an opposite chamber aft end 16*b*, with a chamber interior surface 16*c* therebetween of length and diameter sized to receive and contain the cylindrical cased telescoped ammunition round 11; in the forward position, the chamber inner edge 16*d* is received in concentric fit in overlap formation portion 12*c* of the barrel breech (see FIG. 1*b*). Each chamber 16-i can slide in the rearward direction, over an associated stud means 18 having an exterior diameter slightly less than the chamber interior surface 16*c* diameter. Each chamber member 16 is completely free to rotate about its longitudinal axis and about the periphery of the associated stud 18. Stud means 18 has (see especially FIGS. 1 and 1*a*) a lip formation 18*a* on the inward edge, i.e. extending forward over about 180° of the forward face edge, nearest to the rotor axis 14*a*. The alignment of the chamber with the common barrel/stud axes can be maintained via the fit of the stud diameter within the chamber interior 16*c* diameter, although the preferred alignment of the chamber is via its fit within the rotor pocket 14*p*. Each stud means 18 contains firing pin means 20 of form well known to the Gatling gun arts; the firing pin may be actuated by a firing drive mechanism, forming e.g. part of means 10*a*, operatively coupled to means 20 through the aft end of the stud, or through a slot oriented radially outward and located at some chosen location along the length of the stud. The rotor 14, bearing its plurality of barrels 12, associated cartridge chambers 16, studs 18 and firing mechanisms 20, all rotate within a stationary housing means 22. Fore and aft bearing means 24*a* and 24*b*, interior respectively of stationary housing fore end 22*a* and aft end 22*b* and retained by rotor formations 14*r* and housing formations 22*r*, support the rotor and its moving complement of barrel, chambers, studs and firing mechanisms. The interior surface 22*i* of the housing has formed thereon an operating channel 22*c*, having projecting radially inward therefrom a forward edge formation 22*d* with a rear camming surface 22*d'* which bears against the cartridge chamber fore end 16*a*, and a channel aft edge formation 22*e* with a forward camming surface 22*e'* which bears against the chamber aft end 16*b*. The housing has at least one aperture 22*pq* formed therethrough, typically in an area about a position diametrically opposed to the position at which cartridges are fired, for providing cartridge entry and exit routes. Loading of the cylindrical live ammunition round 11 may be through a first port 22*p*, with unloading of a fired round 11' through another port 22*q*, where ports 22*p* and 22*q* may be different portions of single aperture 22*pq*; unloading and loading are respectively aided by the respective extractor surface 28 and loading surface 29*a* of guide bars 30, operating in suitable rotor slots 14*d*.

Figure 3:
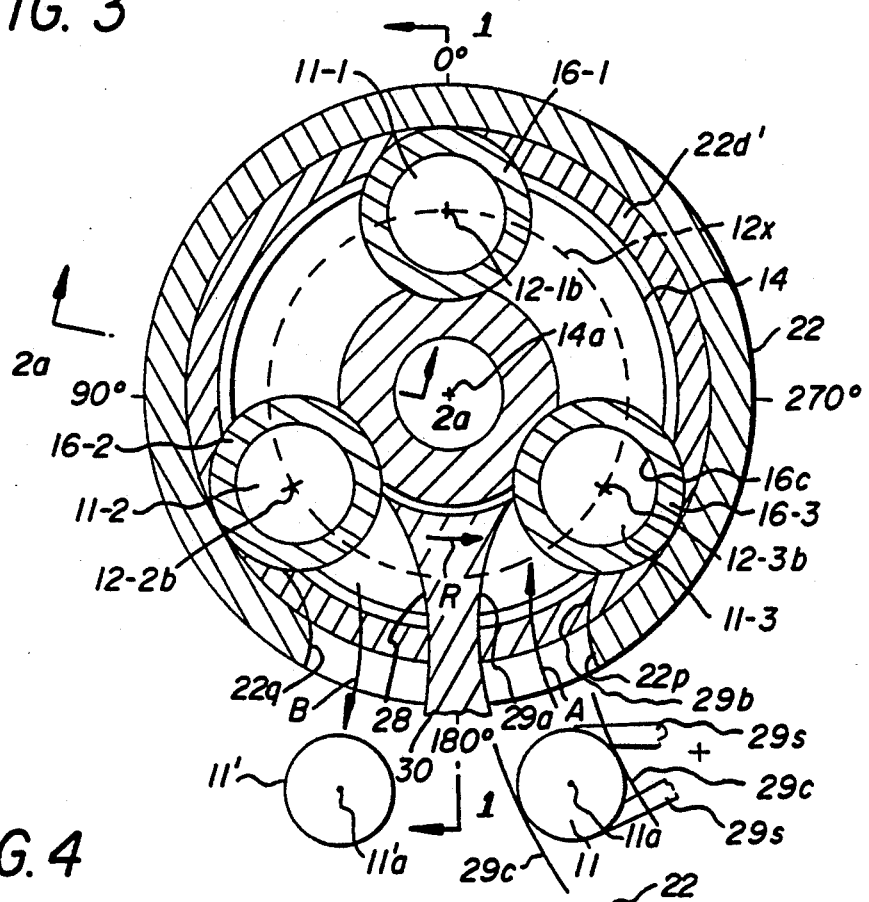
FIG. 3 is a sectional view along the lines of arrows 3—3 of FIG. 1.
Figure 4:
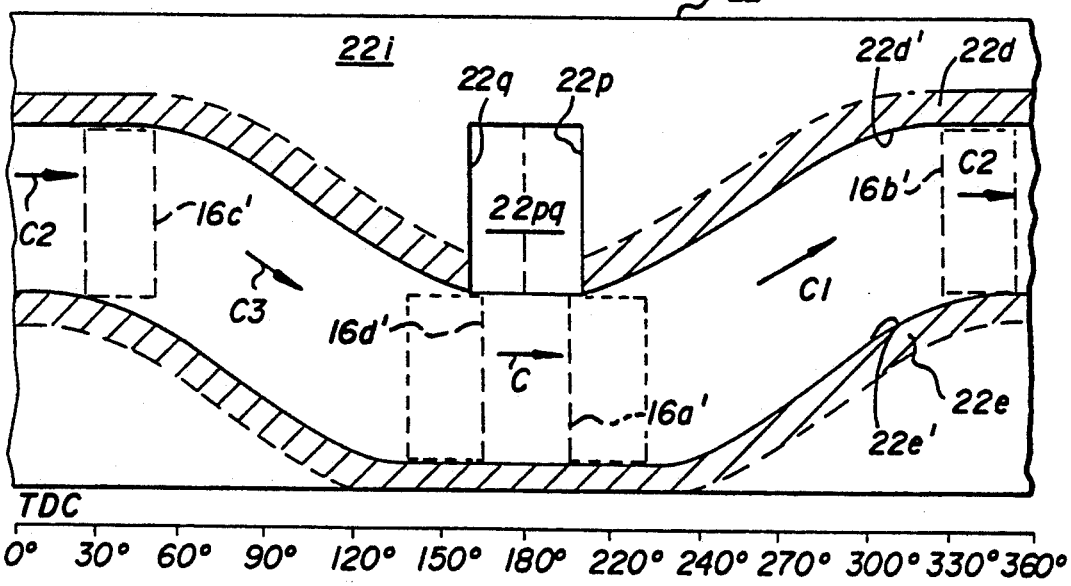
FIG. 4 is a plan view of the interior surface of the stationary gun housing, when rolled out onto a flat surface, and illustrating the shape of the operating channel formed therein.

As best seen in FIG. 3, rotor 14 moves in the direction of arrow R (e.g. counterclockwise as viewed from the aft end of the mechanism). The rotation of rotor 14 will be described with respect to 0° of travel (top dead center, or TDC) being at the 12 o'clock position, at which position the gun has fired, and is in the middle of the firing dwell period. Basic gun functions are provided through the reciprocating motion of cartridge chambers 16, in their individual gun rotor pockets 14*p* formed about the associated stud 18, responsive to the axial camming action of fixed camming channel 22*c* on interior surface 22*i* of gun housing 22 (FIG. 4). In contrast to a conventional Gatling gun, each round 11 is loaded, fired and unloaded without axial motion of the ammunition. The absence of axial cartridge motion allows the cartridge loading and unloading transfer to be located at the same axial position, i.e. with loading port 22*p* and unloading port 22*q* being axially disposed immediately behind the breech end of each barrel 12-i, when each barrel is rotated down into the vicinity of the 6 o'clock position. This may be contrasted with a so-called push-through approach to chambering of cased telescoped ammunition, in which approach the feed and unload ports are at opposite ends of the firing chamber.

A typical gun cycle, looking forward at the section of FIG. 3, with reference to the camming channel details of FIG. 4, proceeds as follows during one counterclockwise rotation of rotor 14:

(a) With the rotor at the 180° (6 o'clock) position shown by the section in FIG. 1 below rotor centerline 14*a*, the associated chamber 16'*a* (shown in phantom in FIG. 4) is at its rearmost dwell position and there is no round 11 of ammunition present in the chamber volume 16*v*, in this position.

(b) The rotor moves in the direction of arrow R until the 5 o'clock position (at an angle of about 210°) is reached, wherein the cased telescoped round 11 is moved, initially by feed means having e.g. a feed chute 29*c* and the teeth 29S of at least one feed sprocket, and then by surface 29*a* and chamber rotation radially inwardly and tangentially coincident along the barrel centerline circle 12*x* (FIG. 3), in the direction of arrow A (FIGS. 3 and 4) through port 22*p* and into the volume 16*v* which will be enclosed by the associated cartridge chamber 16 when it moves forward. (We therefore define radial cartridge movement to be with respect to the rotor axis 14*a* and to include necessary tangential components, as a round is moved into the chamber volume; radial movement thus excludes substantially all axial movement, toward or away from a plane orthogonal to the rotor axis.) Thus, as seen in FIG. 3, a round 11-3 has been moved into the proper radial position and aligned with the barrel and stud axes (after traveling inward, aided by loading surfaces 29*a*/29*b*, with substantially constant tangential velocity) and is about to be enclosed within the cartridge chamber interior volume (defined by surface 16*c*) of chamber 16-3, which is located with its axis along the axis 12-3*a* of the third barrel 12-3. At this time, the chamber is actually in the rearward position shown by phantom chamber 16'*a*, in FIG. 4. At the 5 o'clock position, the round 11-3 is thus loaded in place and held thereat by some means, which may include the guide surface 29*a* of fixed guide bars 30 and other guide surfaces 29*b* for radial control, transfer sprockets (not shown) for tangential control and preferably includes semicircular stud lip formations 18*a* and barrel lip formations 12*r* to engage the chamfered edges of the round, and the like) until chamber 16'*a*, moved by the rear camming surface forward edge 22*e'* of operating channel 22*c*, begins its forward ram cycle portion, moving in the direction of arrow C1, and enclosing the round.

(c) Continuing rotation in the direction of arrow R until the rotor has reached approximately the 1 o'clock position (at a rotation of about 330°), the chamber 16'*b* has reached its forward-most position (shown by phantom chamber 16'*b* in FIG. 4) and the round is now completely surrounded by chamber 16 (e.g. chamber 16-3 has completely enclosed cartridge 11-3). The chamber forward end 16*a* is now substantially in abutment with the breech of barrel 12-3. At this position, the chamber may, if desired, be locked in place, utilizing means which are not shown but are well known in the art.

(d) The primer is now initiated; firing pin means 20, having been previously cocked, is now released to fire round 11, while the cartridge chamber 16 is at its forward dwell position, i.e. between about 330° and about 30°. This forward dwell time, or angle, is appropriately sized to allow the firing functions (primer initiation, interior ballistic cycle, projectile muzzle exit and exhaust gas blowdown) to occur. The cartridge chamber pressure is contained by the chamber member 16 in the radial direction and by the stud 18 and barrel 12 in the fore/aft axial direction. Generally, the cartridge is fired just prior to top dead center, i.e. 0°, so that the projectile exits the muzzle at the time that the barrel axis is at TDC; thus, cartridge 11-1, within cartridge chamber 16-1, aligned with barrel 12-1 (near the 12 o'clock position shown in the top portion of FIG. 1 and above rotor axis 14*a*) has been fired and only a spent casing 11'*b* is within chamber 16-1. It is preferred that, with the chamber member 16 in its most forward position, during firing dwell, there be (FIG. 1*b*) a physical overlap of the chamber fore end 16*a* inner edge 16*d* over the barrel breech outer lip 12*r*, to provide a concentric piloting diameter to precisely maintain chamber-to-barrel alignment during firing. Similarly, because the chamber member is of length longer than the cartridge length, the chamber aft end 16*b* is still engaged over the stud 18 and a continued stud-chamber alignment results.

Figures 2A, 2B:
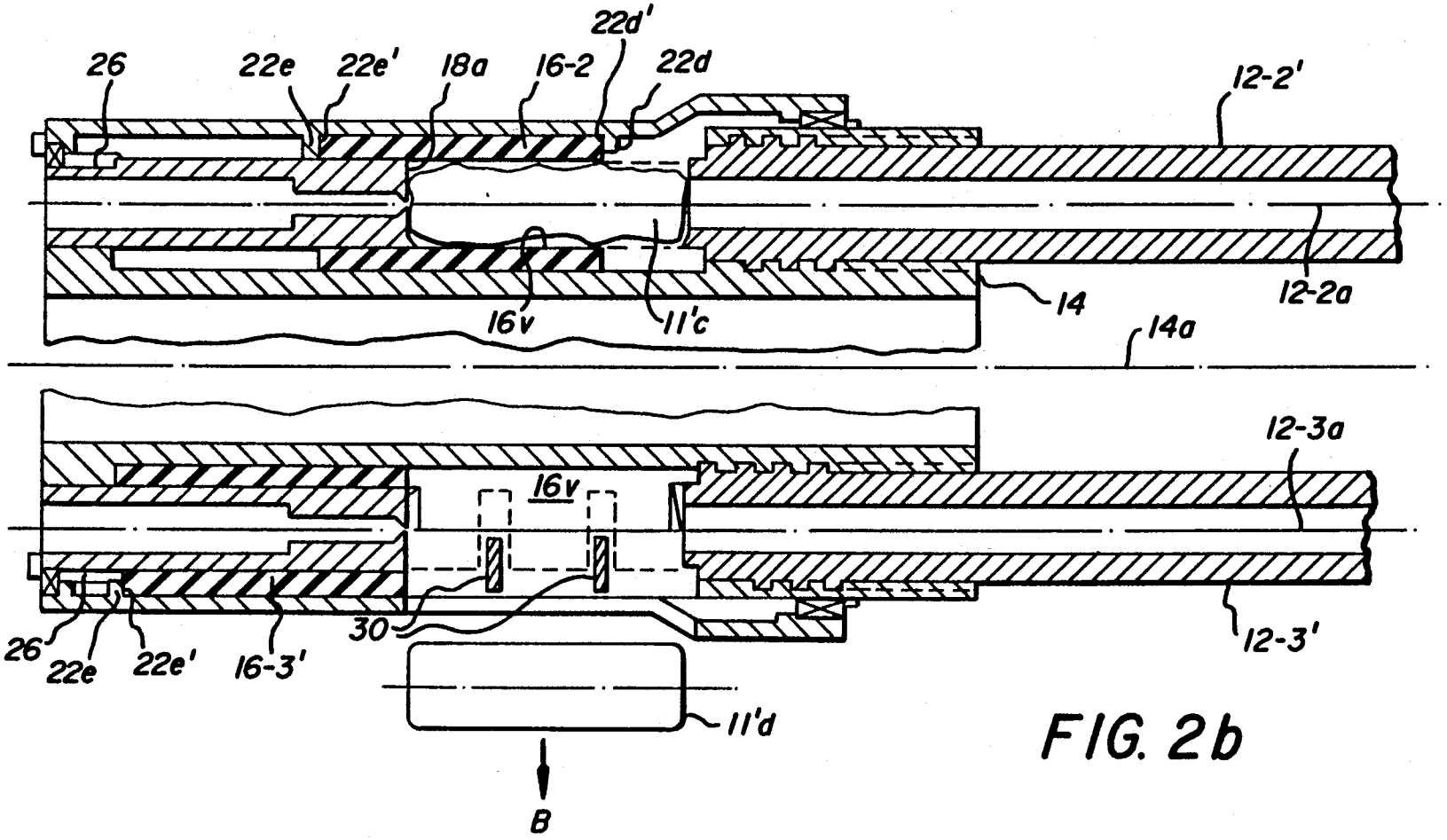
FIGS. 2*a* and 2*b* are sectional views through other parts, and at other angles of rotation, of the rotating mechanism of the present invention.

(e) Completing the movement in the direction of arrow C2, the forward dwell period ends when chamber 16'*c* reaches approximately the 11 o'clock position (at about 30° of rotation). The chamber is now unlocked, if locking means are utilized. In any event, the chamber begins reverse travel in the backward direction of arrow C3, toward the rear dwell position. The spent round 11'*b* remains in place, while the cartridge chamber moves in a rearward direction, urged by the rear face 22*d*' of the channel camming forward edge 22*d*. FIG. 2*a* is illustrative of the relationship of another gun barrel 12-2' at approximately the 9 o'clock position, at which position the associated cartridge chamber 16-2 has been urged about one third of the way towards the rear, by action of forward camming surface rear edge 22*d*'. Note that the spent round casing 11'*c* remains in position between the forward face 18*a* of the stud and the rear face of the barrel.

(f) The rearward movement of chamber 16 continues in the direction of arrow C3 until the chamber (as shown by phantom chamber 16'*d*) is approximately at the 7 o'clock position (e.g. at about 150° of rotation). When chamber 16'*d* has reached the rear dwell position, the spent case 11'*d* is available to be unloaded, or ejected (see FIG. 2*b*). Thus, illustrative cartridge chamber 16-3' has moved to its rearmost position, and is currently located about stud 18-3; the ejector surface 28 of guide means 30 has slid under the radially-innermost surface of spent case 11'*d*, and has disengaged the case from stud lip 18*a* and barrel lip 12*r* and pushed the case outwardly, in the direction of arrow B, through port 22*q*.

(g) Rotation continues in the direction of arrow R, with the now empty chamber volume 16*v* moving to the 6 o'clock position. Thereafter, rotation continues until volume 16*v* is again at the 5 o'clock position, wherein another live round 11 is loaded and the forward ram portion of the cycle eventually again commences, when the rear dwell portion ends at about 210° of rotation. Thus, the forward ram portion is facilitated by the operating cam rear edge 22*e* moving its forward surface 22*e*' in the forward direction; reciprocally, the rear ram portion is facilitated by the operating cam front edge 22*d* moving its rear surface 22*d*' in the rear direction. The combination of cams 22*d* and 22*e* provide longitudinal control of chamber position substantially through the totality (i.e. about 100%) of the gun operating cycle.

It will be seen that in the simplest form cartridge chamber 16 are not locked in forward dwell (e.g. forward-positioned chamber 16'*b* of FIG. 4), although in some configurations locking may be desirable to minimize load path and subsequent gun rotor 14 deflections and stresses; in either case, the basic operational principle remains the same. Higher firing rates and smaller gun size are achievable with a non-locking chamber. It will also be noted that should a new round 11 of ammunition fail to be provided through port 22*p* at the proper time, a missing round will be easily accommodated by gun mechanism 10. The associated cartridge chamber 16 will still actually reciprocate, and the firing pin 18 associated with that chamber will still be actuated at the proper point on the rotational cycle to fire a round, although there will be no firing as the round is missing. Since the rotor is continuously turned (by external means) during operation, the stationary housing operating cam surfaces will still reciprocate the cartridge chamber to its rear-most position, so that the subsequent presence of another ammunition round 11 at port 22*p* will allow the chamber volume 16*v* to be filled and the new round to be fired through its associated barrel when next that barrel and now-loaded chamber 16 reach the firing position.

While one presently preferred embodiment of our novel gun mechanism for firing cased telescoped ammunition has been described in some detail herein, many variations and modifications will now become apparent to those skilled in the weapons arts. It is our intent, therefore, to be limited only by the scope of the appended claims and not by the particular details and instrumentalities presented by way of explanation herein.

What is claimed is:

1. A Gatling-type gun mechanism, comprising:

a stationary housing having a camming channel and at least one port;

a rotor mounted in said housing for rotation about a longitudinal axis;

a plurality of gun barrels, each fixed to said rotor with a respective barrel axis substantially parallel to said longitudinal axis;

a like plurality of stud assemblies, each having a respective axis aligned with the axis of an associated gun barrel;

a like plurality of cartridge chambers, each interacting with said camming channel, during each rotation of said rotor, for longitudinal reciprocal motion between a rearward location substantially coaxial about the associated stud assembly and a forward location substantially in abutment with the associated gun barrel and enclosing a volume into which a round of ammunition can be placed and removed by radial movement through said at least one port;

each of said stud assemblies having means for firing a round of ammunition within said enclosed volume, when the rotor moves the associated barrel, chamber and stud assembly to a firing location.

2. The gun mechanism of claim 1, wherein the fore end of each chamber and the breech end of the associated barrel have substantially complementary mating formations thereon, for maintaining substantially concentric engagement therebetween during ammunition firing.

3. The gun mechanism of claim 1, wherein at least one of the stud and barrel associated with each chamber have a formation over at least a portion of the face thereof facing the chamber volume, for positioning the round within said volume.

4. The gun mechanism of claim 1, wherein each cartridge chamber is a cylindrical member.

5. The gun mechanism of claim 4, wherein the axis of each chamber is substantially aligned with the axis of the associated barrel during the entire reciprocating cycle of chamber movement.

6. The gun mechanism of claim 4, wherein the axis of each chamber is also substantially aligned with the axis of the associated stud during the entire reciprocating cycle of chamber movement.

7. The gun mechanism of claim 1, wherein the camming channel is formed upon an interior surface of said stationary housing.

8. The gun mechanism of claim 7, wherein each chamber is positioned for free rotation about its longitudinal axis during all portions of axial travel.

9. The gun mechanism of claim 7, wherein said housing camming channel has an aft edge formation moving said chamber forward during at least a loading portion of each rotor revolution, and a fore edge formation moving said chamber rearward during at least an unloading portion of the same rotor revolution.

10. The gun mechanism of claim 9, wherein the aft edge formation is a forward surface of the aft edge of said camming channel, and the fore edge formation is a rear surface of the camming channel fore edge.

11. The gun mechanism of claim 9, wherein said chamber has a forward edge directly engaging said fore edge formation during at least a portion of the chamber axial movement cycle, and has an aft edge directly engaging said aft edge formation during at least another portion of the chamber movement cycle.

12. The gun mechanism of claim 1, further comprising means for moving each of a sequential series of said ammunition rounds through a loading one of said at least one port and into sequential ones of said cartridge chamber volumes.

13. The gun mechanism of claim 12, wherein said rotor also includes means for ejecting spent ammunition through an unloading one of said at least one port, after firing and before the rotor has moved through a full rotation with respect to the location at which the ammunition was loaded into a chamber volume.

14. The gun mechanism of claim 13, wherein the ammunition is of the cased telescoped type.

15. The gun mechanism of claim 13, wherein ammunition in said moving means is moved substantially only in the radial direction, during round loading radially inward through said loading port, around said rotor axis and ejection radially outward through said unloading port.

16. The gun mechanism of claim 15, wherein the loading and unloading ports are provided by a single housing aperture.

* * * * *